US012729092B2

(12) United States Patent
Casotti et al.

(10) Patent No.: US 12,729,092 B2
(45) Date of Patent: Sep. 8, 2026

(54) INTERFOLDING MACHINE

(71) Applicant: OT LUCCA S.R.L., Montecarlo (IT)

(72) Inventors: Paolo Casotti, Lucca-Frazione di Antraccoli (IT); Valter Ceccarelli, Chiesina Uzzanese (IT)

(73) Assignee: OT LUCCA S.R.L., Montecarlo (IT)

( * ) Notice: Subject to any disclaimer, the term of this patent is extended or adjusted under 35 U.S.C. 154(b) by 290 days.

(21) Appl. No.: 18/707,661

(22) PCT Filed: Nov. 2, 2022

(86) PCT No.: PCT/IB2022/060561
§ 371 (c)(1),
(2) Date: May 6, 2024

(87) PCT Pub. No.: WO2023/079458
PCT Pub. Date: May 11, 2023

(65) Prior Publication Data

US 2026/0152362 A1 Jun. 4, 2026

(30) Foreign Application Priority Data

Nov. 5, 2021 (IT) ..... 102021000028229

(51) Int. Cl.
*B65H 45/24* (2006.01)
*B65H 45/18* (2006.01)
(Continued)

(52) U.S. Cl.
CPC ..... *B65H 45/24* (2013.01); *B65H 45/18* (2013.01); *B65H 45/228* (2013.01); *B65H 45/28* (2013.01);
(Continued)

(58) Field of Classification Search
CPC ..... B65H 29/56; B65H 45/18; B65H 45/20; B65H 45/228; B65H 45/24;
(Continued)

(56) References Cited

U.S. PATENT DOCUMENTS 3,229,974 A 1/1966 Banks
4,874,158 A * 10/1989 Retzloff ..... B65H 29/56 270/39.02
(Continued)

FOREIGN PATENT DOCUMENTS

EP 2437994 A1 4/2012
JP 2002068582 A 3/2002

OTHER PUBLICATIONS

International Search Report and Written Opinion for International Patent Application No. PCT/IB2022/060561, Feb. 10, 2023, 8 pages.

*Primary Examiner* — Leslie A Nicholson, III
(74) *Attorney, Agent, or Firm* — Jacob M. Ward; Ward law Office LLC

(57) ABSTRACT

An interfolding machine comprising means for transforming a rotary motion into an oscillating motion which move the first folding fingers and which are coupled in input to a toothed driven gear receiving drive from a toothed drive gear via a toothed belt or a chain and means for making the first folding roller and the toothed drive gear rotate in synchrony. The interfolding machine advantageously comprises a guide which engages the toothed belt or the chain and which is movable with respect to the frame in such a way as to vary the pathway of one of the branches between the toothed drive gear and the toothed driven gear, an actuator which moves the guide so as to regulate the position of the first folding fingers with respect to the angular position of the first folding roller and control means.

12 Claims, 8 Drawing Sheets

(51) Int. Cl.
*B65H 45/22* (2006.01)
*B65H 45/28* (2006.01)

(52) U.S. Cl.
CPC .... *B65H 2301/166* (2013.01); *B65H 2403/25* (2013.01); *B65H 2403/40* (2013.01); *B65H 2555/11* (2013.01); *B65H 2555/12* (2013.01)

(58) Field of Classification Search
CPC ..... B65H 2403/21; B65H 2403/25; B65H 2403/40; B65H 2513/50; B65H 2511/20; B65H 2555/12
USPC ..... 270/39.05, 39.06
See application file for complete search history.

(56) References Cited

U.S. PATENT DOCUMENTS

| | | | | |
|---|---|---|---|---|
| 6,228,014 | B1 * | 5/2001 | De Matteis | B65H 29/56 493/425 |
| 2012/0071311 | A1 * | 3/2012 | Ricci | B65H 29/56 493/454 |
| 2021/0047142 | A1 * | 2/2021 | Mazzaccherini | B65H 45/24 |
| 2023/0416042 | A1 * | 12/2023 | Damiani | B65H 29/56 |

* cited by examiner

PRIOR ART

INTERFOLDING MACHINE

FIELD OF THE INVENTION

The present invention relates to the technical sector regarding the production of interfolded packs of sheet articles. In this technical sector, interfolding machines are normally used that ensure the formation of interfolded packs of sheet articles obtained by cutting or perforating continuous strips, usually originating from the unwinding of reels. In greater detail, the present invention relates to the regulating of the position of the folding fingers with respect to the angular position of the folding roller.

DESCRIPTION OF THE PRIOR ART

The advantages of the use of interfolded packs produced with interfolding machines such as, for example, the one described in EP 2437994 B1, are known. In like interfolding machines, as with the one illustrated in FIG. 1, before or during the unwinding and folding of the strips, cuts or lines or pre-cut perforations or tear lines are realised so as to produce sheet articles which are moved by a roller, known as a folding roller, and folded by folding fingers which collect them from the folding roller and interpose them with the sheet articles coming from the opposite side and folded by other folding fingers, not illustrated in FIG. 1. The quality of the interfolded packs mainly depends on the interaction between the folding roller and the folding fingers. Typically the folding roller is provided with recesses and channels in which a depression is formed, so as to attract the sheet articles and take them into the area where the stack is formed, and the folding fingers enter and exit from gullies made on the folding roller, detaching the articles and creating the fold. The alternating motion of the folding fingers is obtained using means for transforming a rotary motion in input into an oscillating motion in output. Mechanical oscillators are often used, typically with cams, for example with globoid cams, which comprise an input shaft and an output shaft.

To guarantee synchrony between the rotation of the folding roller and the alternated motion of the folding fingers, the input shaft of the mechanical oscillator is usually coupled to the movement means of the folding roller.

On increasing the operating velocity of the interfolding machine, it is preferable or necessary to advance the movement of the folding fingers with respect to the movement of the sheet article due to a plurality of reasons. FIG. 7 gives an example of the above-described adjustment, showing, at the top, a first diagram with, on the horizontal axis, the angular position of point A of the folding roller over time and showing, at the centre and below, diagrams with, on the horizontal axis, the angular position of the folding fingers over time. The desired cycle is visible at the centre, with respect to the cycle of the folding roller, in the case of a first velocity, and at the bottom, the desired cycle is shown for the case of a second velocity, greater than the first velocity. It can be seen, in the diagram at the bottom, how the cycle of the folding fingers is advanced so as to enable more greatly slowing down the sheet articles that are moved at a higher velocity and to balance the non-perfect alignment between the filling and emptying time of the recesses and channels under depression, configured to operate at a lower velocity and, therefore, with longer times.

The above adjustment of the folding fingers, sometimes indicated with the term "timing", is particularly delicate for the good functioning of the interfolding machine and for obtaining interfolded packs with the sheet articles folded correctly. The initial adjustment, carried out with the interfolding machine stationary, is well adapted for a velocity or adapts to a velocity range but outside that range is not adequate, as it causes a deterioration in the quality of the interfolded packs. This limitation is particularly relevant when attempts are being made to increase the production lines, in both existing systems and in new installations. Further, it is often requested to slow the interfolding machine down, for example in a case of an issue in the production line, upstream or downstream.

FIG. 1 shows an interfolding machine of known type. In detail, a solution at present in use is visible to adjust the position of the first folding fingers with respect to the angular position of the first folding roller. The left-most pulley is splined on a shaft driven by the cutting roller which rotates in synchrony with the folding roller. The lowest pulley is splined to the input of a mechanical oscillator that moves the folding fingers and is coupled to the left-most pulley by means of a toothed belt so as to rotate in synchrony. The left-most pulley is solidly constrained to the shaft by means of a keyless friction splining device. With the interfolding machine stationary it is therefore possible to regulate the orientation of the pulley lower with respect to the left-most pulley, i.e. the reciprocal angular positions thereof, deconstraining the left-most pulley from the shaft and acting on the small toothed wheel borne by the pulley which drives the toothed sector solidly constrained to the shaft.

Another solution of the prior art for regulating the position of the first folding fingers with respect to the angular position of the first folding roller includes the use of a differential and a motor, as illustrated in EP 2437994 B1.

The solution of FIG. 1 does not permit adjustments with the folding roller in motion, while the solution with the differential is expensive, subject to frequent breakdowns as well as tending to propagate vibrations.

The present invention intends to obviate one or more drawbacks of the solutions of the prior art.

SUMMARY OF THE INVENTION

A first aim of the present invention is to provide an interfolding machine of sheet articles which guarantees the quality of the interfolded pack in the various operating conditions.

A second aim is to guarantee the regulating of the interfolding machine during the operations, i.e. while the interfolding machine continues interfolding the sheet articles.

An aim of some embodiments is to guarantee the adjustments of small entity, i.e. fine adjustments.

A further aim of some embodiments is to enable the regulating of the interfolding machine without hampering the functioning thereof, for example reducing the duration of some components or increasing the frequency of the maintenance operations.

These and other aims, which will become clearer to the expert from a reading of the text that follows are attained by an interfolding machine for production of interfolded packs of sheet articles from strips, of a method for operating an interfolding machine and of a method for making a position of the first folding fingers adjustable with respect to the angular position of the first folding roller in an interfolding machine according to the claims.

In accordance with the teachings of the present document, the interfolding machine comprises a frame, cutting means for realising cuts or lines or pre-cutting or tearing perforations on strips so as to produce sheet articles, a first folding roller for moving sheet articles which rotates with respect to the frame about a respective rotation axis, first folding fingers for folding the sheet articles moved by the first folding roller which are movable with respect to the frame in such a way as to move away from and towards the first folding roller, a second folding roller for moving sheet articles which rotates with respect to the frame about a respective rotation axis and second folding fingers for folding the sheet articles moved by the second folding roller.

The first folding roller, the first folding fingers, the second folding roller and the second folding fingers cooperate with one another to interfold the sheet articles.

The interfolding machine further comprises means for transforming a rotary motion in input into an oscillating motion in output which comprise an input shaft and an output which is connected to the first folding fingers so as to move them, a toothed drive gear which rotates with respect to the frame about a respective rotation axis, a toothed driven gear which rotates with respect to the frame about a respective rotation axis and which is coupled to the input shaft so as to rotate together, a toothed belt or a chain which engages the toothed drive gear and the toothed driven gear so as to transmit the motion in synchrony and means for making the first folding roller and the toothed drive gear rotate so that the toothed drive gear rotates in synchrony with the first folding roller.

The interfolding machine further advantageously comprises a guide which engages the toothed belt or the chain and which is movable with respect to the frame in such a way as to vary the pathway of one of the branches between the toothed drive gear and the toothed driven gear, an actuator which moves the guide between a first position corresponding to a first orientation of the toothed driven gear with respect to the toothed drive gear and a second position corresponding to a second orientation of the toothed driven gear with respect to the toothed drive gear in order to adjust the position of the first folding fingers with respect to the angular position of the first folding roller and control means for controlling the actuator which determine the position of the guide on the basis of the rotation velocity of the first folding roller.

BRIEF DESCRIPTION OF THE DRAWINGS

A first embodiment of each of the methods and specific embodiments of the invention will be described in the following part of the present description, according to what is set down in the claims and with the aid of the accompanying figures of the drawings, in which:

Figure 6:
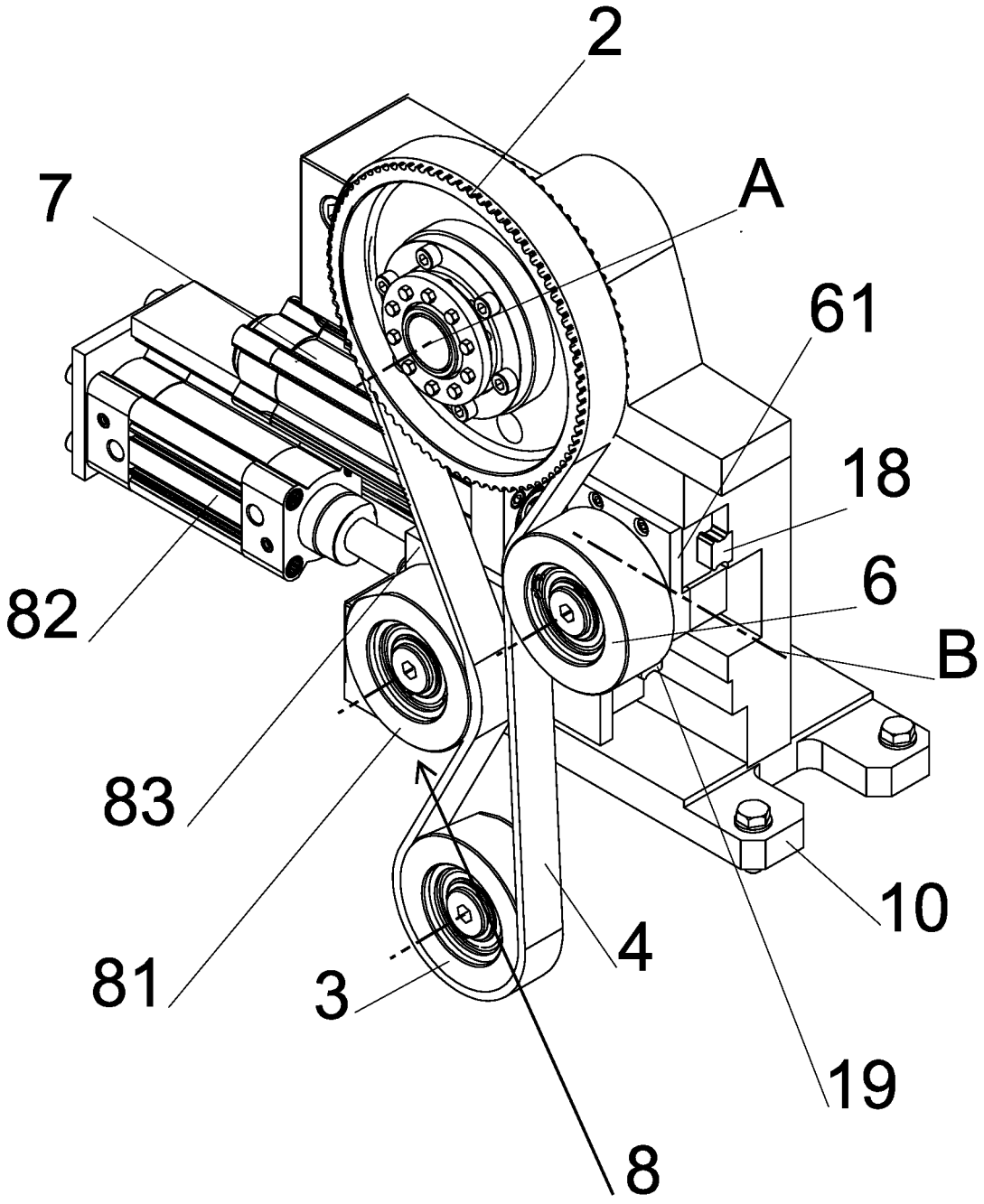
FIG. 6 is an axonometric view of a group of the interfolding machine of FIG. 2.
Figure 8:
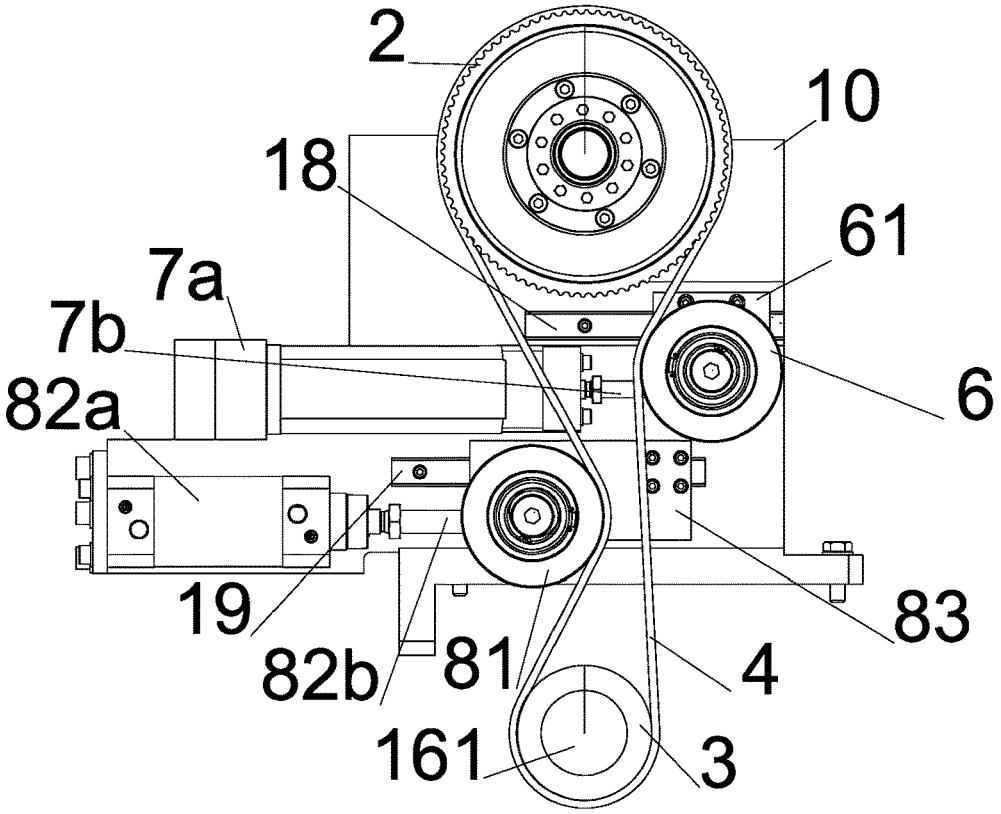
Figure 9:
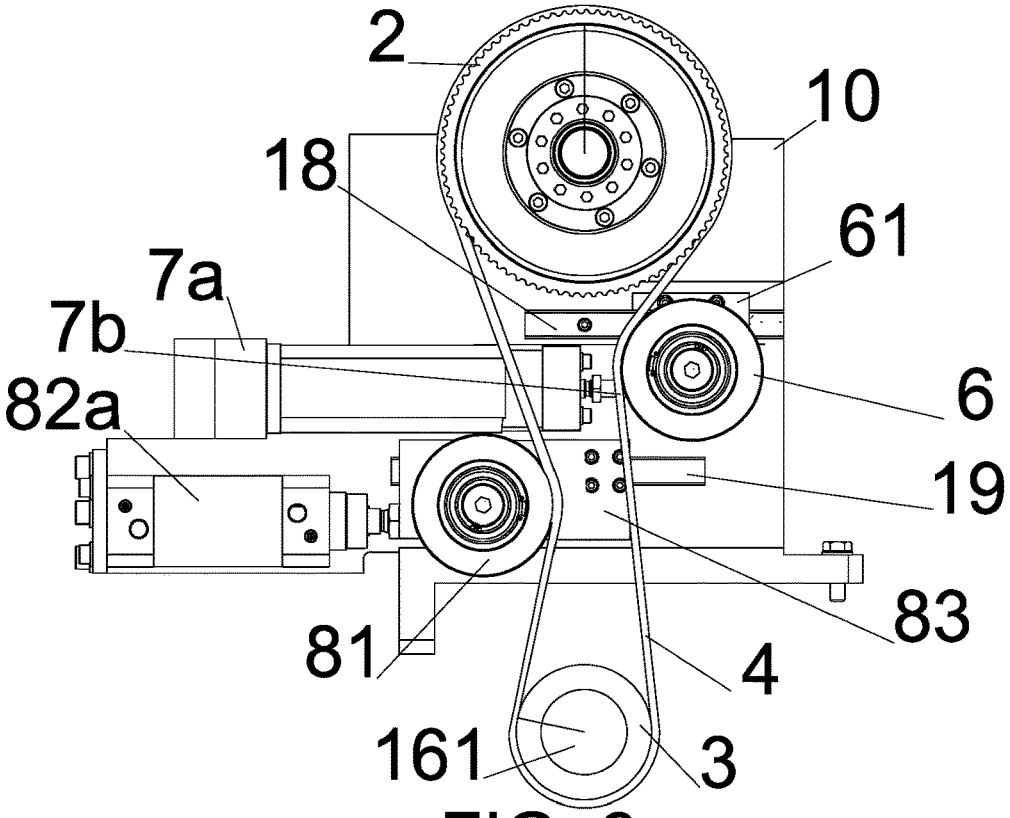

FIGS. from 8 to 12 show lateral views of different embodiments of the group of FIG. 6, with FIGS. 8 and 9 showing the same embodiment in different operating conditions.

DESCRIPTION OF THE PREFERRED EMBODIMENTS

With reference to the appended figures, reference numeral 100 denotes an interfolding machine (100) for production of interfolded packs of sheet articles from strips, usually obtained from the unwinding of reels.

An embodiment of the machine (100) comprises:

- a frame (10);
- cutting means for realising cuts or lines or pre-cutting or tearing perforations on strips so as to produce sheet articles;
- a first folding roller (11) for moving sheet articles, which rotates with respect to the frame (10) about a respective rotation axis, i.e. is rotationally connected to the frame (10);
- first folding fingers (13) for folding the sheet articles moved by the first folding roller (11) which are movable with respect to the frame (10) so as to move away from and towards the first folding roller (11);
- means for transforming a rotary motion in input into an oscillating motion in output, which comprise an input shaft (161) and an output which is connected to the first folding fingers (13) so as to move the first folding fingers (13);
- a toothed drive gear (2) which rotates with respect to the frame (10) about a respective rotation axis, i.e. it is rotationally connected to the frame (10);
- a toothed driven gear (3) which rotates with respect to the frame (10) about a respective rotation axis, i.e. it is rotationally connected to the frame (10), and which is coupled to the input shaft (161) so as to rotate together, i.e. to rotate in unison with the input shaft (161);
- a toothed belt or a chain (4) which engages the toothed drive gear (2) and the toothed driven gear (3) so as to transmit the motion synchronously, i.e. so that the toothed drive gear (2) and the toothed driven gear (3) rotate in unison;
- means (5) for making the first folding roller (11) and the toothed drive gear (2) rotate so that the toothed drive gear (2) rotates in synchrony with the first folding roller (11);
- a second folding roller (12) for moving sheet articles, which rotates with respect to the frame (10) about a respective rotation axis, i.e. is rotationally connected to the frame (10);
- second folding fingers (14) for folding the sheet articles moved by the second folding roller (12);
- a guide (6) which engages the toothed belt or the chain (4) and which is movable with respect to the frame (10) in such a way as to vary the pathway of one of the branches between the toothed drive gear (2) and the toothed driven gear (3);
- an actuator (7) which moves the guide (6) between a first position corresponding to a first orientation of the toothed driven gear (3) with respect to the toothed drive gear (2) and a second position corresponding to a second orientation of the toothed driven gear (3) with respect to the toothed drive gear (2), in order to adjust the position of the first folding fingers (13) with respect to the angular position of the first folding roller (11);

control means (9) for controlling the actuator (7) which determine the position of the guide (6) on the basis of the rotation velocity of the first folding roller (11).

The first folding roller (11), the first folding fingers (13), the second folding roller (12) and the second folding fingers (14) cooperate with one another to interfold the sheet articles.

Figure 7:
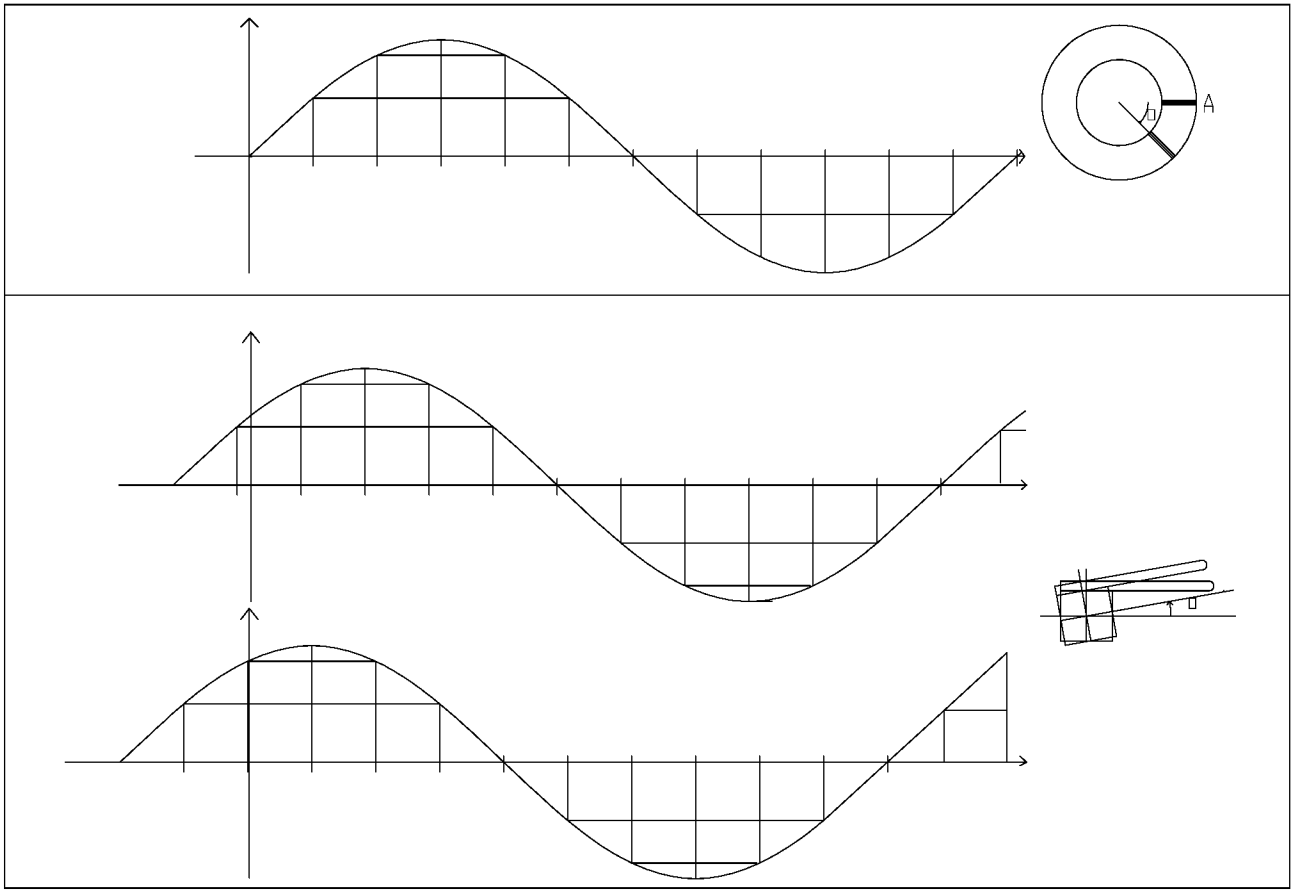
FIG. 7 shows diagrams relating to the desired angular positions of the folding fingers with respect to the folding roller at different rotation velocities of the folding roller.

As can be seen in FIG. 7, the orientation of the first folding roller (11) with respect to the frame (10) is correlated to the position of the first folding fingers (13) with respect to the frame (10) to guarantee the operability of the interfolding machine (100). The position of the first folding fingers (13) and the angular position of the first folding roller (11) indicate the orientation of the first folding roller (11) and the arrangement of the first folding fingers (13) with respect to a system of coordinates. In the example of FIG. 7, the position of the first folding fingers (13) can be defined by the angular position thereof, i.e. the angular position of a material point thereof.

The interfolding machine (100) of the invention enables regulation of the advance or delay of the first folding fingers (13) simply, controllably with precision and with mechanical devices that are easy to find on the market and to maintain. Further, the adjustments do not require halting the interfolding machine (100).

With the toothed drive gear (2) stationary, the variation of the orientation of the toothed driven gear (3) with respect to the toothed drive gear (2) leads to a rotation of the toothed driven gear (3). FIGS. 8 and 9 show examples of the variation of the angle formed between the straight lines passing between two reference diameters respectively of the toothed driven gear (3) and of the toothed drive gear (2) downstream of the displacement of the guide (6).

The guide (6) can usually assume multiple positions between the first position and the second position.

As will be better illustrated in the following, the teachings of the present invention are also applicable on existing interfolding machines (100).

Figure 1:
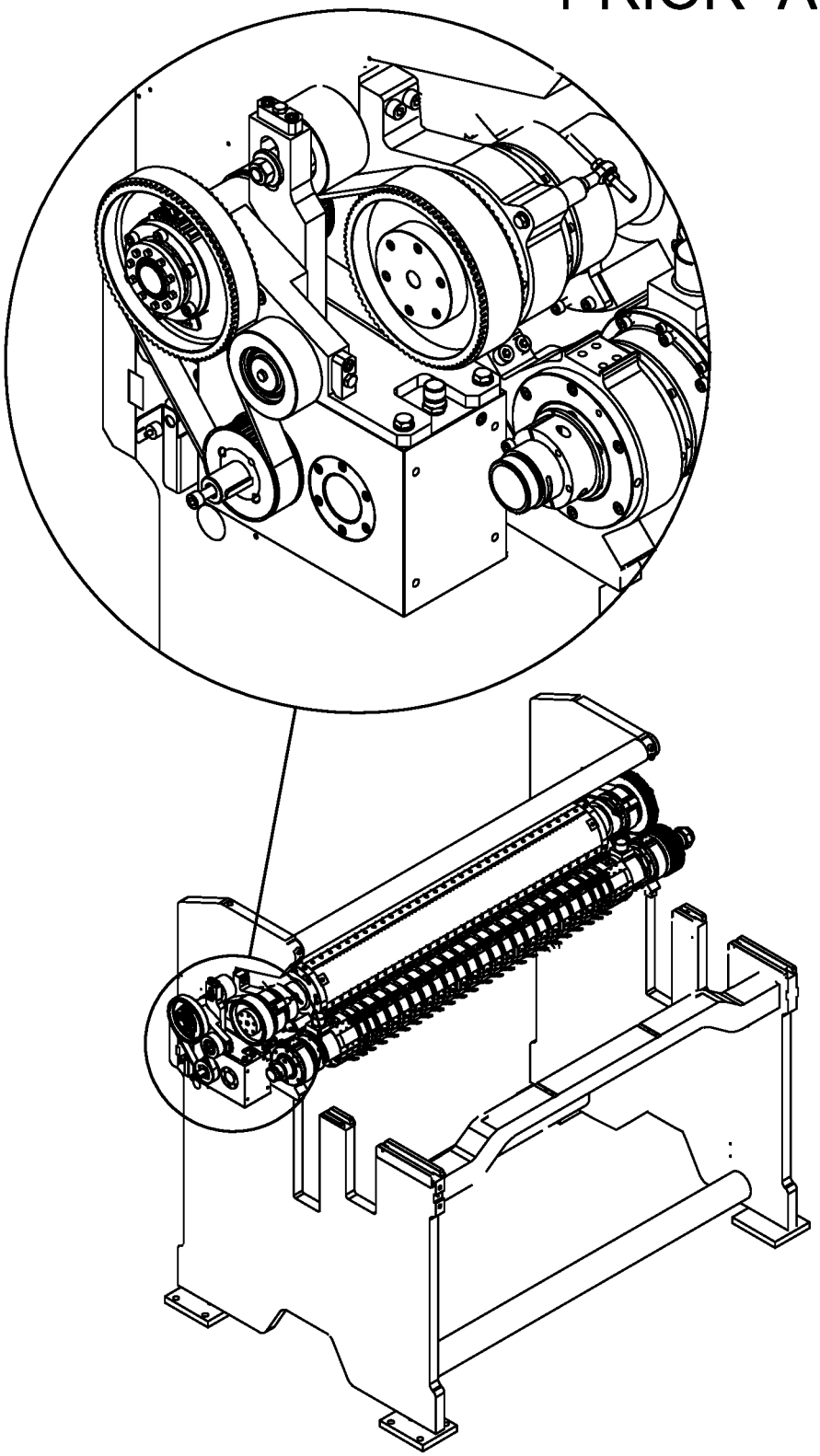
FIG. 1 is an axonometric view with a detail of an interfolding machine of the prior art with elements not represented.
Figure 2:
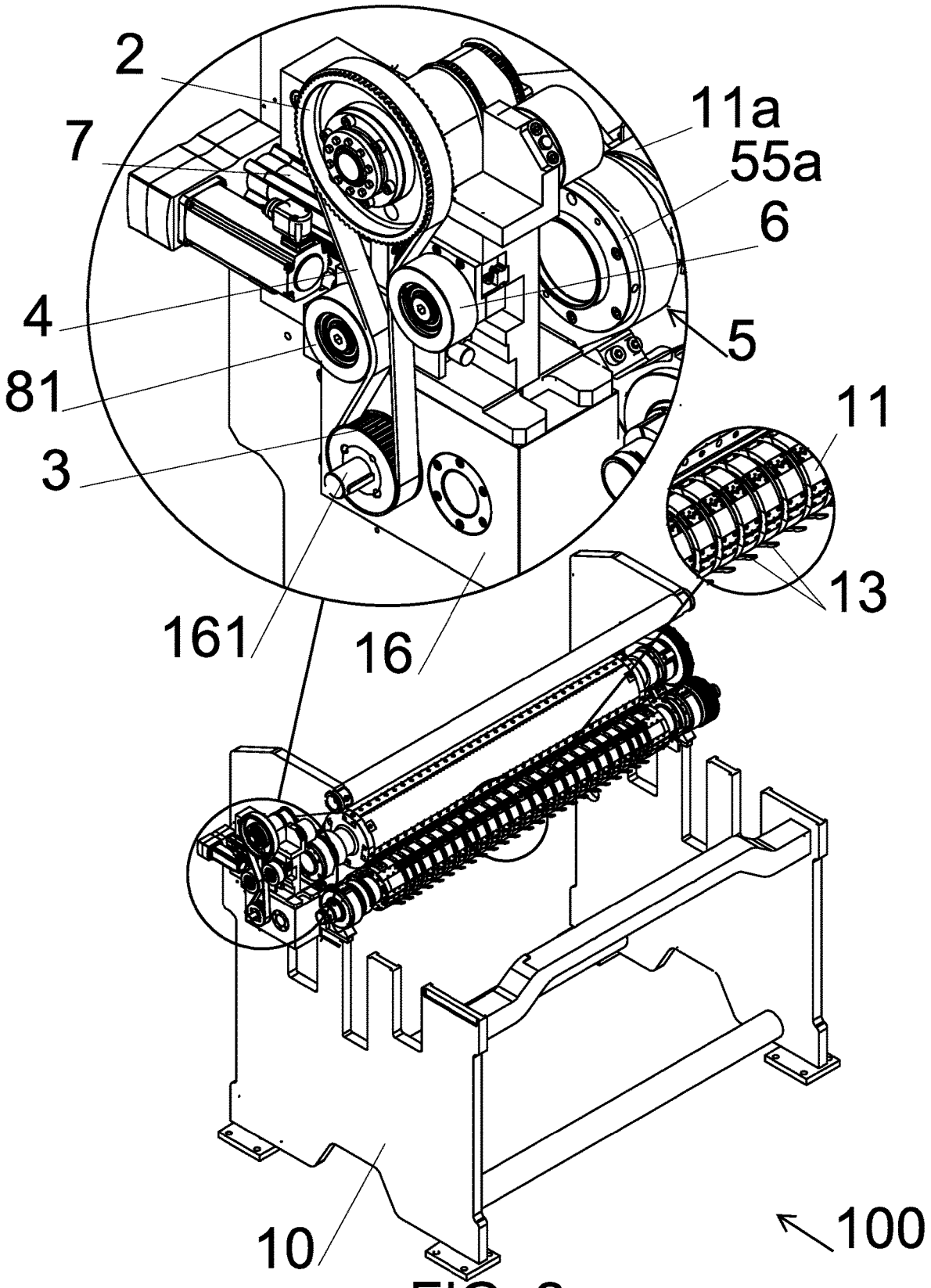
FIG. 2 is an axonometric view with details of an embodiment of an interfolding machine according to the invention, with some elements not represented.

As in the case of the example embodiment of FIG. 2, the interfolding machine (100) preferably comprises a bar (15) which bears the first folding fingers (13) and which is movable with respect to the frame (10) in such a way that the first folding fingers (13) can move away from and towards the first folding roller (11).

The bar (15) enables easily moving the first folding fingers (13) in unison.

As in the case of the embodiment illustrated in FIG. 2, the means for transforming a rotary motion in input into an oscillating motion in output preferably comprise a mechanical oscillator (16) for transforming the rotary motion in input into an oscillating motion in output which has the input shaft (161) and which has an output shaft (162) which, more preferably, moves the bar (15).

The prior art contains other versions of the means for transforming a rotary motion in input into an oscillating motion in output and/or movement systems (17) which connect the output shaft (162), or more in general the output, and the first folding fingers (13). By way of example, the means can comprise mechanical oscillators, mechanical cam systems or connecting rod crankshaft systems.

Figure 5:
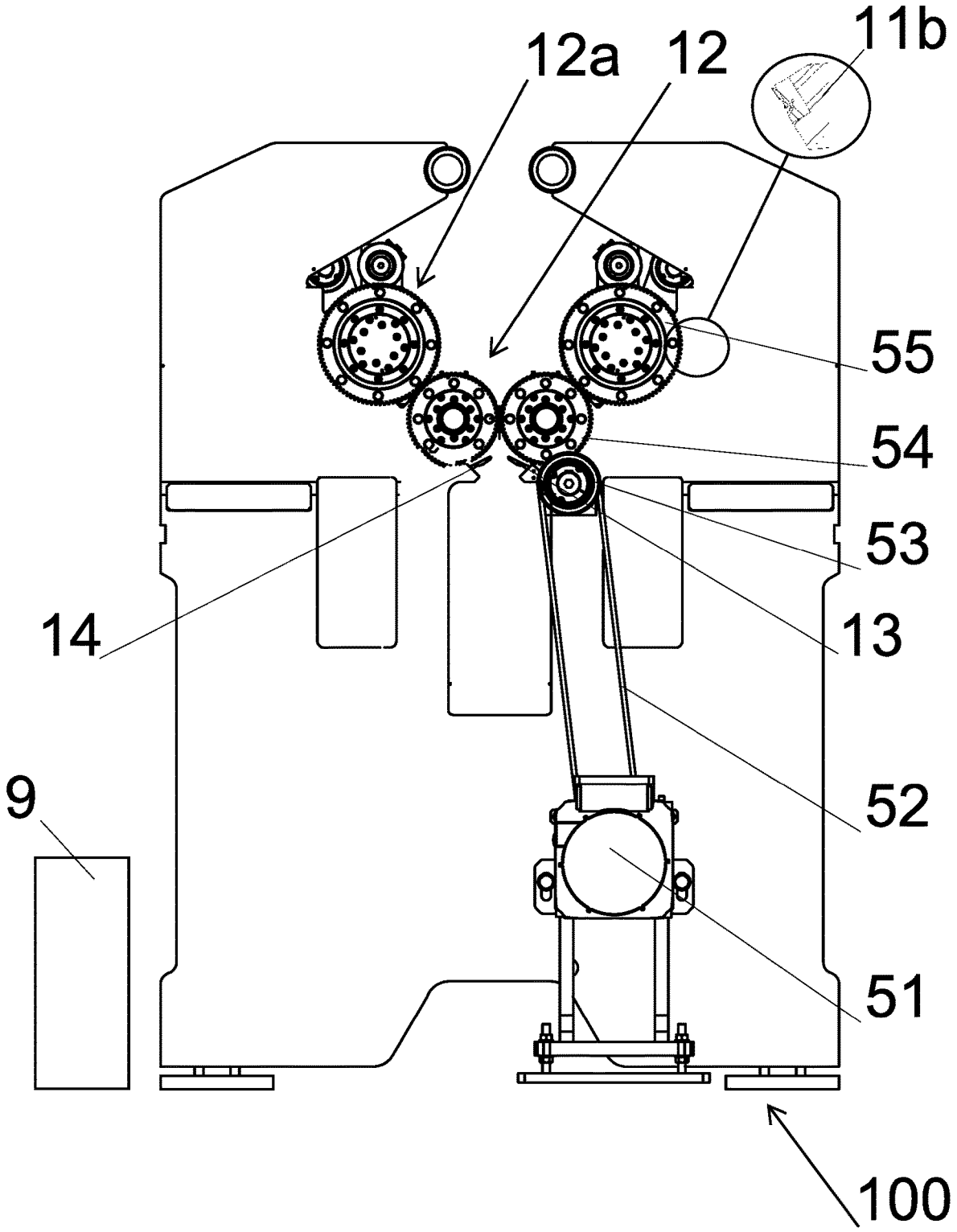
FIG. 5 is a lateral view of the interfolding machine of FIG. 2 in which the fixed cutting beam is also schematically represented.

The cutting means preferably comprise blades or cutters typically associated to counter-blades. In common configurations, the interfolding machine (100) comprises a first cutting roller (11*a*) which bears blades or cutters, or these can be borne by the first folding roller (11). FIG. 5 also schematically illustrates in partial section a fixed cutting beam (11*b*) which bears a counter-blade that cooperates with the blade or blades of the first cutting roller (11*a*).

The control means (9) preferably also control a second actuator (82), described in the following, on the basis of the rotation velocity of the first folding roller (11).

The control means (9) generally comprise a programmable logic control or a computer, or possibly an electric circuit. FIG. 2 alone illustrates these as an electronic control board internally of a cabinet. The velocity of the first folding roller (11) can be indicated by a signal in entry or the control means (9) can comprise a detector of the velocity, for example a position transducer or encoder. The control means (9) preferably receive the velocity of the first folding roller (11) from the controller of the motor (51), especially if the controller is of the electronic control type. Often the control means (9) means also control and command other elements of the interfolding machine (100).

The control means (9) are configured to act on the actuator (7) and, possibly, on the second actuator (82) so as to guarantee the quality of the interfolded pack in any operating condition. Typically, though not necessarily, the installing technician calculates the regulating parameters, which generally depend on the characteristics of the production line, the material used, the processed sheet article, etc. For example, for each velocity it is possible to have an available guide position (6) and thus the actuator (7) position. According to the type of tensioner (8), for each velocity it would be possible to register a position of the second guide (81) and, possibly, of the second actuator (82).

In the case of small variations in the position of the toothed belt or chain (4), the tension might stay within the parameters of the project but, in general, the presence of a tensioner (8) is necessary.

The interfolding machine (100) preferably comprises a tensioner (8) of the toothed belt or of the chain (4) which maintains the toothed belt or the chain (4) under tension as the position of the guide (6) changes.

Figure 12:
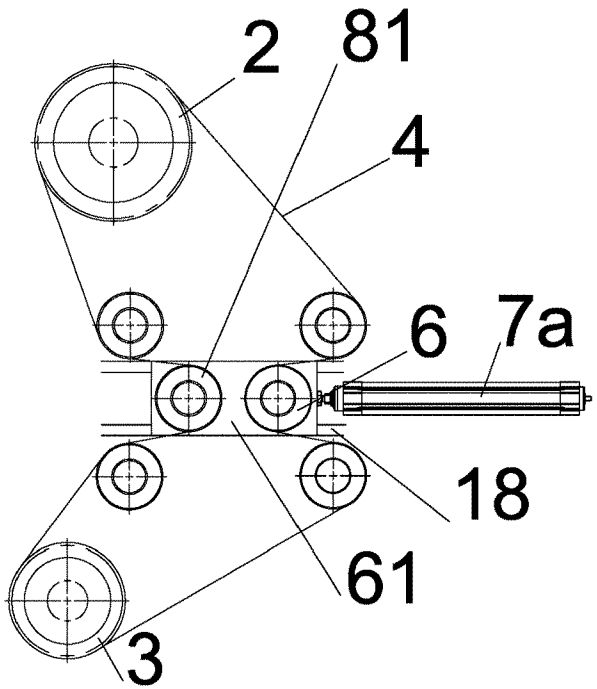
Figure 11:
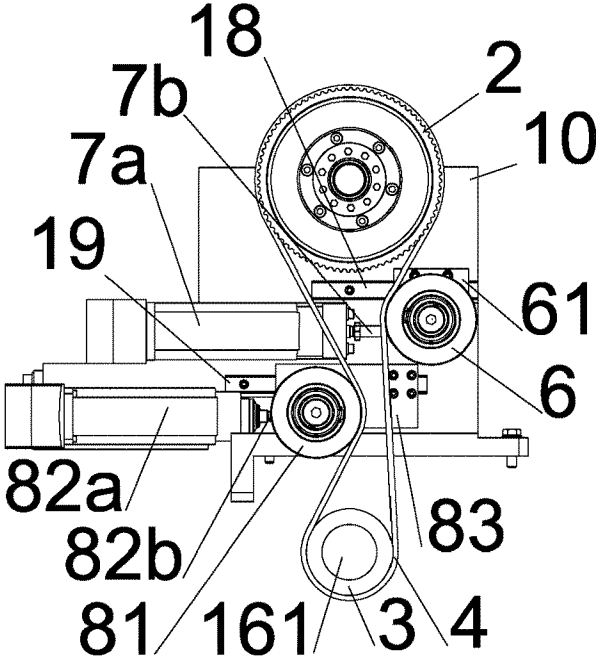

FIG. 12 illustrates a particularly simple embodiment of the tensioner (8) in which, owing to the arrangement of the pulleys, of the guide (6) and the second guide (81), it is possible to obtain similar variations on the two branches, with only one actuator (7) available.

Owing to the presence of the tensioner (8), the adjustment does not lead to any variation on the functioning of the interfolding machine (100), which continues to operate with similar conditions of wear and risk of breakage, differently to what occurs in the prior art in the case of introduction of a differential mechanism.

The toothed belt or the chain (4) is preferably a toothed belt, as illustrated in the appended figures of the drawings. The use of a toothed belt (4) in a configuration according to the invention ensures a reduction in the transmission of the vibrations among the components on the interfolding machine (100), with consequent benefits in terms of performance and duration of the components and quality of the interfolded packs.

Typically, in the case of use of a toothed belt (4), the toothed drive gear (2) and the toothed driven gear (3) are both a toothed pulley.

Although the guide (6) can be arranged on the driven branch or on the drive branch, in the appended figures the guide (6) is arranged on the driven branch of the toothed belt (4) and the tensioner (8) is arranged on the drive branch.

The guide (6) and the second guide (81) can be a belt guide or a roller, a pinion or other devices of known type.

The pathway of the toothed belt or the chain (4) might be modified by acting in various directions but better performance is achieved and a more easily-understood functioning by keeping the pathway on a plane.

Preferably:

- the tensioner (8) comprises a second guide (81) which engages the toothed belt or the chain (4) and a second actuator (82) which is a linear actuator and moves the second guide (81) in such a way as to vary the pathway of the toothed belt or of the chain;
- the rotation axes of the toothed drive gear (2), of the toothed driven gear (3), of the guide (6) and of the second guide (81) are parallel to one another and arranged in a first direction (A);
- the guide (6) is borne by a first carriage (61) which slides on a first linear rail (18) which is integral with the frame (10) and arranged in a second direction (B) orthogonal to the first direction (A);
- the second guide (81) is borne by a second carriage (83) which slides on a second linear rail (19) which is integral with the frame (10) and arranged in the second direction (B);
- the actuator (7) is a first linear actuator which has a fixed part (7*a*) which is integral with the frame (10) and a movable part (7*b*) which is connected to the first carriage (61) and which is movable in the second direction (B);
- the second actuator (82) has a fixed part (82*a*) which is integral with the frame (10) and a movable part (82*b*) which is connected to the second carriage (83) and which is movable in the second direction (B).

This configuration, visible by way of example in FIG. 6, enables a precise regulating of the position of the guide (6) and of the second guide (81), and thus the relative orientation between the toothed drive gear (2) and the toothed driven gear (3). Further, the position of the second guide (81), in order to guarantee the same tensioning downstream of the displacement of the guide (6), can easily be defined with simple geometrical calculations. It is specified that in FIG. 6 some parts of the actuator (7) are not represented so as to afford a better view of the second actuator (82).

More preferably, the displacements of the guide (6) and the second guide (81) lie on a same vertical plane.

The second actuator (82) is preferably a pneumatic actuator, so as to provide a constant force. Taking account of the fact that the toothed belt (4) as a fixed extension, the second actuator (82) enables taking up the loosening or greater tensioning of the toothed belt (4) due to the displacement of the guide (6), so as to maintain the toothed belt (4) inside the expected tension intervals.

Other embodiments are possible, for example the second actuator (82) might be of an electrical or hydraulic type, preferably with electronic command, if the desired position of the second guide (81) is known, or in a case where a load or a like device is incorporated, for example in the rod or on the second guide (81).

The regulating of the actuator (7) is preferably precise, so as to obtain interfolded packs of excellent quality. It is therefore preferable for the actuator (7) to be an electric actuator. However similar results can be obtained with a hydraulic actuator, for example an oil-dynamic piston, electronically controlled, so as to perform small steps.

In other embodiments the tensioner (8) comprises a spring (84) and a second guide (81) which engages the toothed belt or the chain (4) and which is movable with respect to the frame (10) in such a way as to vary the pathway of the toothed belt or of the chain (4). On a first side the spring (84) is connected to the frame (10), and on a second side the spring (84) is connected to the second guide (81); further, the spring (84) is arranged in such a way as to tension the toothed belt or the chain (4).

Figure 10:
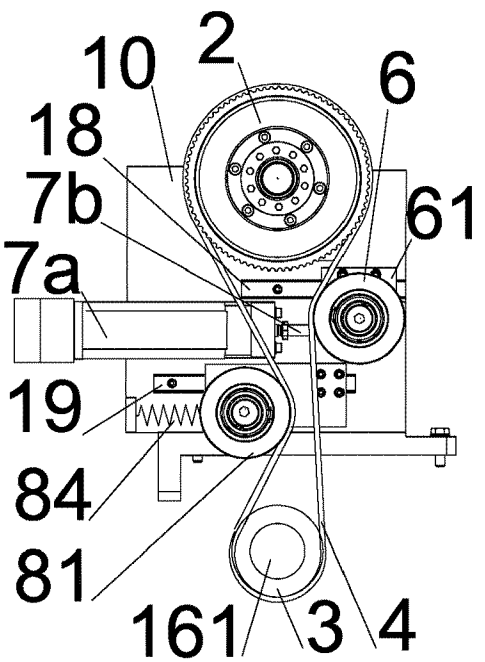

Also in the case of the spring (84), the connection to the frame (10) of the second guide (81) can take place by means of a linear guide; the spring (84) is preferably arranged in the sliding direction of the second guide (81), as illustrated in FIG. 10.

As known to the expert in the sector and as represented in FIG. 5 a second folding roller (12) and second folding fingers (14) are opposed to the first folding roller (11) and the first folding fingers (13) which cooperate to form the interfolded packs. Usually the means for rotating (5) also move the second folding roller (12), the second folding fingers (13), the first cutting roller (11*a*) and the second cutting roller (12*a*). The interfolding machine (100) often comprises a single motor (51), as illustrated in FIG. 5.

FIGS. 2, 3, 4, and 5 show an embodiment of the means for rotating (5), although the technician in the sector knows numerous equivalent or substantially equivalent variants. For example, in the embodiment of the appended figures, the toothed drive gear (2) is moved through the first cutting roller (11*a*) instead of the first folding roller (11) as they rotate in unison, in synchrony, as can be seen from FIGS. 4 and 5. Again by way of example, the toothed drive gear (2) might be set in rotation directly about the drive shaft (51).

With reference to the embodiment illustrated in FIGS. 2, 3, 4 and 5, a motor (51) sets in rotation a first toothed pulley (53) via a belt (52). The first toothed pulley (53) is coupled to a first toothed wheel (53*a*) which enmeshes with a toothed folding wheel (54) which is solidly constrained to the first folding roller (11) and which, in turn, enmeshes with a toothed cutting roller (55) solidly constrained to the first cutting roller (11*a*). The toothed folding wheel (54) is also coupled to a toothed wheel that is solidly constrained to the second folding roller (12) and the coupling also enables moving the second cutting roller (12*a*).

On the opposite side, a cutting pulley (55*a*), solidly constrained to the first cutting roller (11*a*), moves, once more via a further toothed belt, a further toothed pulley splined on a shaft on which the toothed drive gear (2) is splined. The drive is transmitted via the toothed belt (4) to the toothed driven gear (3) splined on the input shaft (161).

Figure 3:
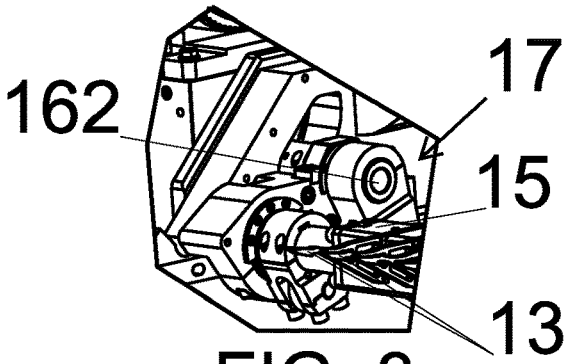
FIG. 3 illustrates a detail of a possible movement of the bar of the first folding fingers not visible in FIG. 4.
Figure 4:
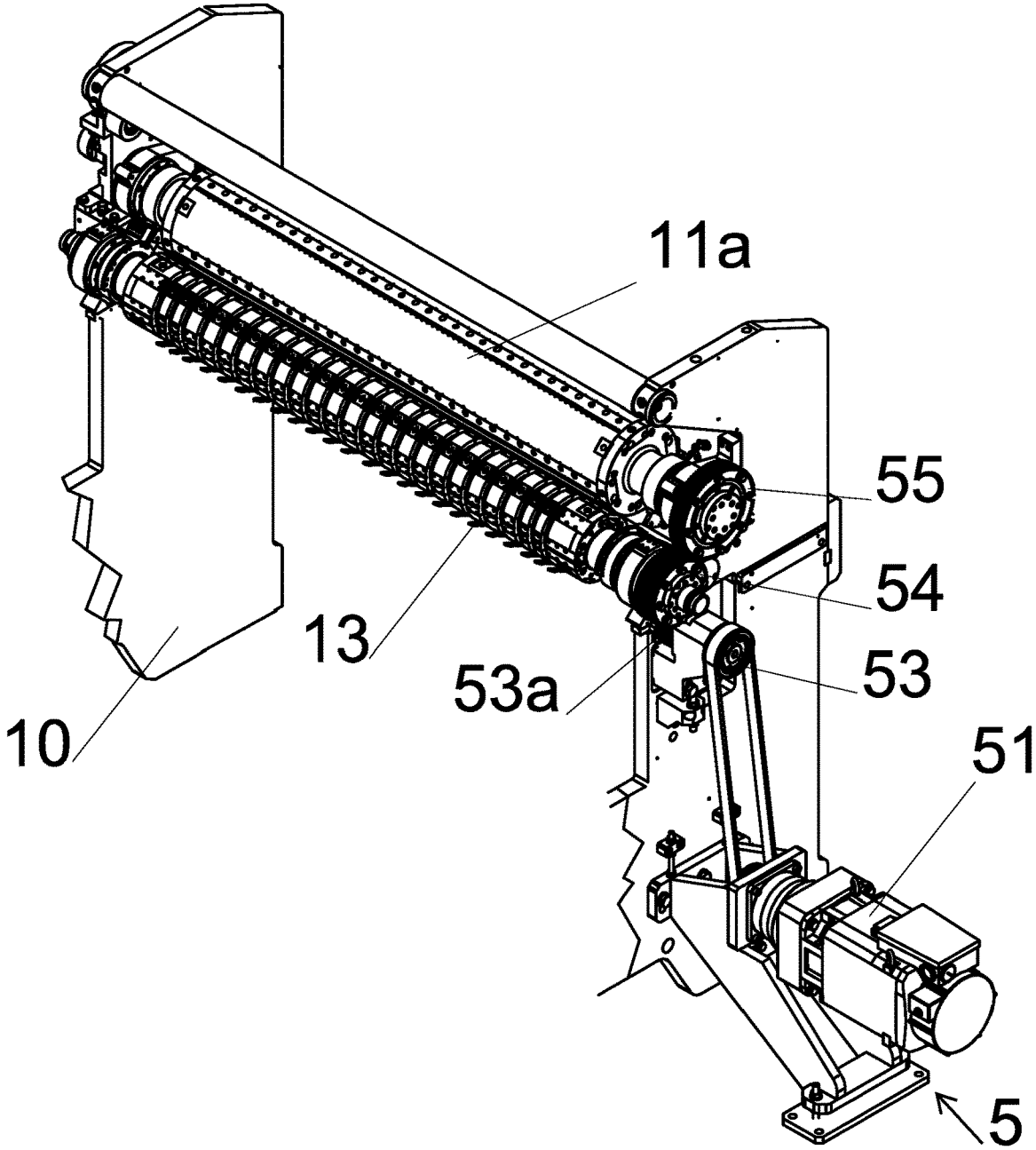
FIG. 4 is a partial axonometric view of the interfolding machine of FIG. 2, from a different viewpoint.

FIG. 3 shows an embodiment of a movement system (17) of known type of the bar (15) via the output shaft (162); numerous substantially equivalent mechanical variants are possible, some of which have been known to the expert in the sector for some time.

The toothed driven gear (3) is preferably associated to a flywheel of known type (not illustrated) which makes the movement of the mechanical oscillator (16) more fluent.

The opposing group to the one represented in FIG. 2 has one or more of the above-described characteristics, and more preferably has the same characteristics as the illustrated group: second cutting roller (12*a*) alike to or identical to the first cutting roller (11*a*), means for transforming a rotary motion in input into an oscillating motion in output, etc.

The invention also relates to a method for operating an interfolding machine (100) according to the teachings of the present description.

An embodiment of the method comprises steps of:

- activating the means (5) for making the first folding roller (11) and the toothed drive gear (2) rotate, bringing the first folding roller (11) to a first rotation velocity;
- varying the rotation velocity of the first folding roller (11) bringing the first folding roller (11) to a second rotation velocity different to the first rotation velocity, usually by acting on the motor (51);

matching the movement of the first folding fingers (13) to the rotation velocity of the first folding roller (11).

The method advantageously comprises a step of determining predetermined positions of the guide (6) on the basis of the velocity of the first folding roller (11) and which in the step of matching the movement of the first folding fingers (13) the actuator (7) is activated so as to bring the guide (6) into the position, of the predetermined positions, corresponding to the second velocity of the first folding roller (11).

Preferably, as mentioned in the foregoing, in the step of matching the movement of the first folding fingers (13) the second actuator (82) is also activated. More preferably the method also comprises the step of determining respective predetermined positions of the second guide (81) on the basis of the velocity of the first folding roller (11) and in the step of matching the movement of the first folding fingers (13) the second actuator (82) is activated so as to bring the second guide (81) into the position, of the respective predetermined positions, corresponding to the second velocity of the first folding roller (11).

The invention also relates to a method for making a position of the first folding fingers (13) adjustable with respect to the angular position of the first folding roller (11) in an interfolding machine (100) which comprises a frame (10), cutting means for realising cuts or lines or pre-cutting or tearing perforations on strips so as to produce sheet articles, a first folding roller (11) for moving sheet articles which rotates with respect to the frame (10) about a respective rotation axis, first folding fingers (13) for folding the sheet articles moved by the first folding roller (11) which are movable with respect to the frame (10) so as to move away from and towards the first folding roller (11), means for transforming a rotary motion in input into an oscillating motion in output which comprise an input shaft (161) and an output which is connected to the first folding fingers (13) so as to move the first folding fingers (13), a toothed drive gear (2) which rotates with respect to the frame (10) about a respective rotation axis, a toothed driven gear (3) which rotates with respect to the frame (10) about a respective rotation axis and which is coupled to the input shaft (161) so as to rotate together, a toothed belt or a chain (4) which engages the toothed drive gear (2) and the toothed driven gear (3) so as to transmit the motion synchronously, means (5) for making the first folding roller (11) and the toothed drive gear (2) rotate so that the toothed drive gear (2) rotates in synchrony with the first folding roller (11), a second folding roller (12) for moving sheet articles which rotates with respect to the frame (10) about a respective rotation axis second folding fingers (14) for folding the sheet articles moved by the second folding roller (12).

The first folding roller (11), the first folding fingers (13), the second folding roller (12) and the second folding fingers (14) cooperate with one another to interfold the sheet articles.

An embodiment of the method comprises steps of:

providing a guide (6);

providing an actuator (7);

connecting the guide (6) to the frame (10) and engaging the guide (6) to the toothed belt or to the chain (4) in such a way that the guide (6) is movable with respect to the frame (10) so as to vary the pathway of one of the branches between the toothed drive gear (2) and the toothed driven gear (3);

connecting the actuator (7) to the frame (10) and to the guide (6) so as to move the guide (6) between a first position corresponding to a first orientation of the toothed driven gear (3) with respect to the toothed drive gear (2) and a second position corresponding to a second orientation of the toothed driven gear (3) with respect to the toothed drive gear (2);

providing control means (9) for controlling the actuator (7), or modifying existing control means, which determine the position of the guide (6) on the basis of the rotation velocity of the first folding roller (11).

The teachings of the present invention are easily applicable to interfolding machines (100) of the prior art, obtaining the advantages described in the foregoing.

In the absence of the transformation of the existing interfolding machine (100), the further teachings as illustrated above can be applied, which find preferred implementation also in the method for making a position of the first folding fingers (13) adjustable with respect to the angular position of the first folding roller (11) in an interfolding machine (100).

It is understood that the above has been described by way of non-limiting example and that any constructional variants are considered to fall within the protective scope of the present technical solution, as claimed in the following.

The invention claimed is:

1. An interfolding machine for production of interfolded packs of sheet articles from strips comprising:

a frame;

cutting means for realising cuts or lines or pre-cutting or tearing perforations on strips so as to produce sheet articles;

a first folding roller for moving sheet articles which rotates with respect to the frame about a respective rotation axis;

first folding fingers for folding the sheet articles moved by the first folding roller which are movable with respect to the frame so as to move away from and towards the first folding roller;

means for transforming a rotary motion in input into an oscillating motion in output which comprise an input shaft and an output which is connected to the first folding fingers so as to move the first folding fingers;

a toothed drive gear which rotates with respect to the frame about a respective rotation axis;

a toothed driven gear which rotates with respect to the frame about a respective rotation axis and which is coupled to the input shaft so as to rotate together;

a toothed belt or a chain which engages the toothed drive gear and the toothed driven gear so as to transmit the motion synchronously;

means for making the first folding roller and the toothed drive gear rotate so that the toothed drive gear rotates in synchrony with the first folding roller;

a second folding roller for moving sheet articles which rotates with respect to the frame about a respective rotation axis;

second folding fingers for folding the sheet articles moved by the second folding roller;

wherein the first folding roller, the first folding fingers, the second folding roller and the second folding fingers cooperate with one another to interfold the sheet articles and wherein the position of the first folding fingers with respect to the angular position of the first folding roller is adjustable, the interfolding machine being characterised in that it comprises:

a guide which engages the toothed belt or the chain and which is movable with respect to the frame in such a way as to vary the pathway of one of the branches between the toothed drive gear and the toothed driven gear;

an actuator which moves the guide between a first position corresponding to a first orientation of the toothed driven gear with respect to the toothed drive gear and a second position corresponding to a second orientation of the toothed driven gear with respect to the toothed drive gear in order to adjust the position of the first folding fingers with respect to the angular position of the first folding roller;

control means for controlling the actuator which determine the position of the guide on the basis of the rotation velocity of the first folding roller.

2. The interfolding machine of claim 1, comprising a tensioner of the toothed belt or of the chain which maintains the toothed belt or the chain under tension as the position of the guide changes.

3. The interfolding machine of claim 2, wherein the toothed belt or the chain is a toothed belt and wherein the toothed drive gear and the toothed driven gear are both a toothed pulley.

4. The interfolding machine of claim 2, wherein:

the tensioner comprises a second guide which engages the toothed belt or the chain and a second actuator which is a linear actuator and moves the second guide in such a way as to vary the pathway of the toothed belt or of the chain;

the rotation axes of the toothed drive gear, of the toothed driven gear, of the guide and of the second guide are parallel to one another and arranged in a first direction;

the guide is borne by a first carriage which slides on a first linear rail which is integral with the frame and arranged in a second direction orthogonal to the first direction;

the second guide is borne by a second carriage which slides on a second linear rail which is integral with the frame and arranged in the second direction;

the actuator is a first linear actuator which has a fixed part which is integral with the frame and a movable part which is connected to the first carriage and which is movable in the second direction;

the second actuator has a fixed part which is integral with the frame and a movable part which is connected to the second carriage and which is movable in the second direction.

5. The interfolding machine of claim 4, wherein the second actuator is a pneumatic actuator.

6. The interfolding machine of claim 1, wherein the actuator is an electric actuator.

7. The interfolding machine of claim 1, wherein the actuator is an electronically controlled hydraulic actuator.

8. The interfolding machine of claim 2, wherein the tensioner comprises a second guide which engages the toothed belt or the chain and which is movable with respect to the frame in such a way as to vary the pathway of the toothed belt or of the chain and a spring which on a first side is connected to the frame, which on a second side is connected to the second guide and which is arranged in such a way as to tension the toothed belt or the chain.

9. A method for operating the interfolding machine of claim 1 comprising steps of:

activating the means for making the first folding roller and the toothed drive gear rotate, bringing the first folding roller to a first rotation velocity;

varying the rotation velocity of the first folding roller bringing the first folding roller to a second rotation velocity different to the first rotation velocity;

matching the movement of the first folding fingers to the rotation velocity of the first folding roller;

the method being characterised in that it comprises a step of determining predetermined positions of the guide on the basis of the velocity of the first folding roller and which in the step of matching the movement of the first folding fingers the actuator is activated so as to bring the guide into the position, of the predetermined positions, corresponding to the second velocity of the first folding roller.

10. A method for making a position of the first folding fingers adjustable with respect to the angular position of the first folding roller in an interfolding machine for production of interfolded packs of sheet articles from strips comprising:

a frame;

cutting means for realising cuts or lines or pre-cutting or tearing perforations on strips so as to produce sheet articles;

a first folding roller for moving sheet articles which rotates with respect to the frame about a respective rotation axis;

first folding fingers for folding the sheet articles moved by the first folding roller which are movable with respect to the frame so as to move away from and towards the first folding roller;

means for transforming a rotary motion in input into an oscillating motion in output which comprise an input shaft and an output which is connected to the first folding fingers so as to move the first folding fingers;

a toothed drive gear which rotates with respect to the frame about a respective rotation axis;

a toothed driven gear which rotates with respect to the frame about a respective rotation axis and which is coupled to the input shaft so as to rotate together;

a toothed belt or a chain which engages the toothed drive gear and the toothed driven gear so as to transmit the motion synchronously;

means for making the first folding roller and the toothed drive gear rotate so that the toothed drive gear rotates in synchrony with the first folding roller;

a second folding roller for moving sheet articles which rotates with respect to the frame about a respective rotation axis;

second folding fingers for folding the sheet articles moved by the second folding roller;

wherein the first folding roller, the first folding fingers, the second folding roller and the second folding fingers cooperate with one another to interfold the sheet articles and wherein the position of the first folding fingers with respect to the angular position of the first folding roller is adjustable, the method comprising steps of:

providing a guide;

providing an actuator;

connecting the guide to the frame and engaging the guide to the toothed belt or to the chain in such a way that the guide is movable with respect to the frame so as to vary the pathway of one of the branches between the toothed drive gear and the toothed driven gear;

connecting the actuator to the frame and to the guide so as to move the guide between a first position corresponding to a first orientation of the toothed driven gear with respect to the toothed drive gear and a second position corresponding to a second orientation of the toothed driven gear with respect to the toothed drive gear;

providing control means for controlling the actuator, or modifying existing control means, which determine the position of the guide on the basis of the rotation velocity of the first folding roller.

11. The interfolding machine of claim 3, wherein:

the tensioner comprises a second guide which engages the toothed belt or the chain and a second actuator which is a linear actuator and moves the second guide in such a way as to vary the pathway of the toothed belt or of the chain;

the rotation axes of the toothed drive gear, of the toothed driven gear, of the guide and of the second guide are parallel to one another and arranged in a first direction;

the guide is borne by a first carriage which slides on a first linear rail which is integral with the frame and arranged in a second direction orthogonal to the first direction;

the second guide is borne by a second carriage which slides on a second linear rail which is integral with the frame and arranged in the second direction;

the actuator is a first linear actuator which has a fixed part which is integral with the frame and a movable part which is connected to the first carriage and which is movable in the second direction;

the second actuator has a fixed part which is integral with the frame and a movable part which is connected to the second carriage and which is movable in the second direction.

12. The interfolding machine of claim 3, wherein the tensioner comprises a second guide which engages the toothed belt or the chain and which is movable with respect to the frame in such a way as to vary the pathway of the toothed belt or of the chain and a spring which on a first side is connected to the frame, which on a second side is connected to the second guide and which is arranged in such a way as to tension the toothed belt or the chain.

* * * * *